US011670845B2

(12) United States Patent
Su

(10) Patent No.: US 11,670,845 B2
(45) Date of Patent: Jun. 6, 2023

(54) ELECTRONIC DEVICE

(71) Applicant: Lenovo (Beijing) Limited, Beijing (CN)

(72) Inventor: Chang Su, Beijing (CN)

(73) Assignee: LENOVO (BEIJING) LIMITED, Beijing (CN)

( * ) Notice: Subject to any disclaimer, the term of this patent is extended or adjusted under 35 U.S.C. 154(b) by 11 days.

(21) Appl. No.: 17/474,071

(22) Filed: Sep. 14, 2021

(65) Prior Publication Data

US 2022/0102832 A1 Mar. 31, 2022

(30) Foreign Application Priority Data

Sep. 30, 2020 (CN) ..... 202022219251.2

(51) Int. Cl.
*H01Q 1/52* (2006.01)
*H01Q 1/24* (2006.01)
*H01Q 1/08* (2006.01)

(52) U.S. Cl.
CPC ..... *H01Q 1/52* (2013.01); *H01Q 1/08* (2013.01); *H01Q 1/24* (2013.01); *H01Q 1/526* (2013.01)

(58) Field of Classification Search
CPC ..... H01Q 1/08; H01Q 1/2258; H01Q 1/2266; H01Q 1/24; H01Q 1/241; H01Q 1/242; H01Q 1/243; H01Q 1/42; H01Q 1/428; H01Q 1/52; H01Q 1/526; H01Q 1/125; H01Q 1/084; H01Q 1/1264
See application file for complete search history.

(56) References Cited

U.S. PATENT DOCUMENTS

2011/0267238 A1* 11/2011 Nekozuka ..... H01Q 1/243 343/702
2016/0308275 A1* 10/2016 Hu ..... H01Q 1/50

* cited by examiner

*Primary Examiner* — Robert Karacsony
(74) *Attorney, Agent, or Firm* — Anova Law Group, PLLC

(57) ABSTRACT

An electronic device includes a base, a connection device, a body, an antenna assembly, and a shield member. The body rotates to a first operating state and a second operating state relative to the base through the connection device. The shield member moves in the base to a shielding state and a non-overlapping state. When the body is in the first operating state, the body is not overlapping with the antenna assembly in a first direction, the shield member is in the non-overlapping state, and the shield member is not overlapping with the antenna assembly in the first direction. When the body is in the second operating state, the body overlaps at least a portion of the antenna assembly in the first direction, the shield member is in the shielding state, and the shield member shields between the antenna assembly and the body.

10 Claims, 6 Drawing Sheets

ELECTRONIC DEVICE

CROSS-REFERENCE TO RELATED APPLICATION

This application claims priority to Chinese Patent Application No. 202022219251.2, filed on Sep. 30, 2020, the entire content of which is incorporated herein by reference.

TECHNICAL FIELD

The present disclosure relates to an electronic device.

BACKGROUND

Electronic devices are devices routinely used by people. Some electronic devices include a plurality of operating states. However, when an electronic device is in different operating states, different antenna assemblies need to be arranged, which causes the structure of the electronic device to be complex.

SUMMARY

Embodiments of the present disclosure provide an electronic device including a base, a connection device, a body, an antenna assembly, and a shield member. The connection device is connected to the base. The body is connected to the connection device. The body rotates to a first operating state and a second operating state relative to the base through the connection device. The antenna assembly is arranged in the base. The shield member is arranged in the base. The shield member moves in the base to a shielding state and a non-overlapping state. When the body is in the first operating state, the body is not overlapping with the antenna assembly in a first direction, the shield member is in the non-overlapping state, and the shield member is not overlapping with the antenna assembly in the first direction. When the body is in the second operating state, the body overlaps at least a portion of the antenna assembly in the first direction, the shield member is in the shielding state, and the shield member shields between the antenna assembly and the body.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

REFERENCE NUMERALS

Figure 1:
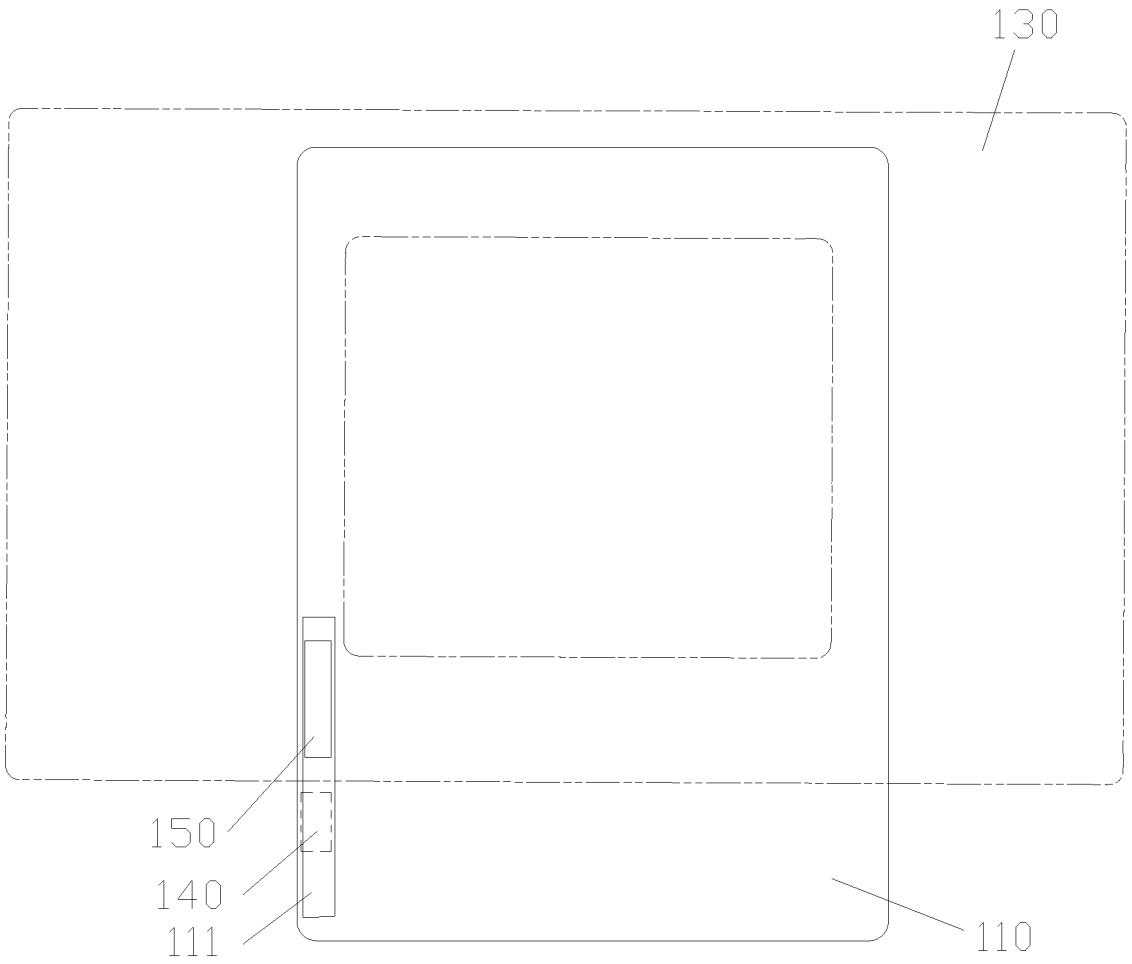
FIG. 1 illustrates a schematic structural diagram of an electronic device in a first operating state according to some embodiments of the present disclosure.
Figure 2:
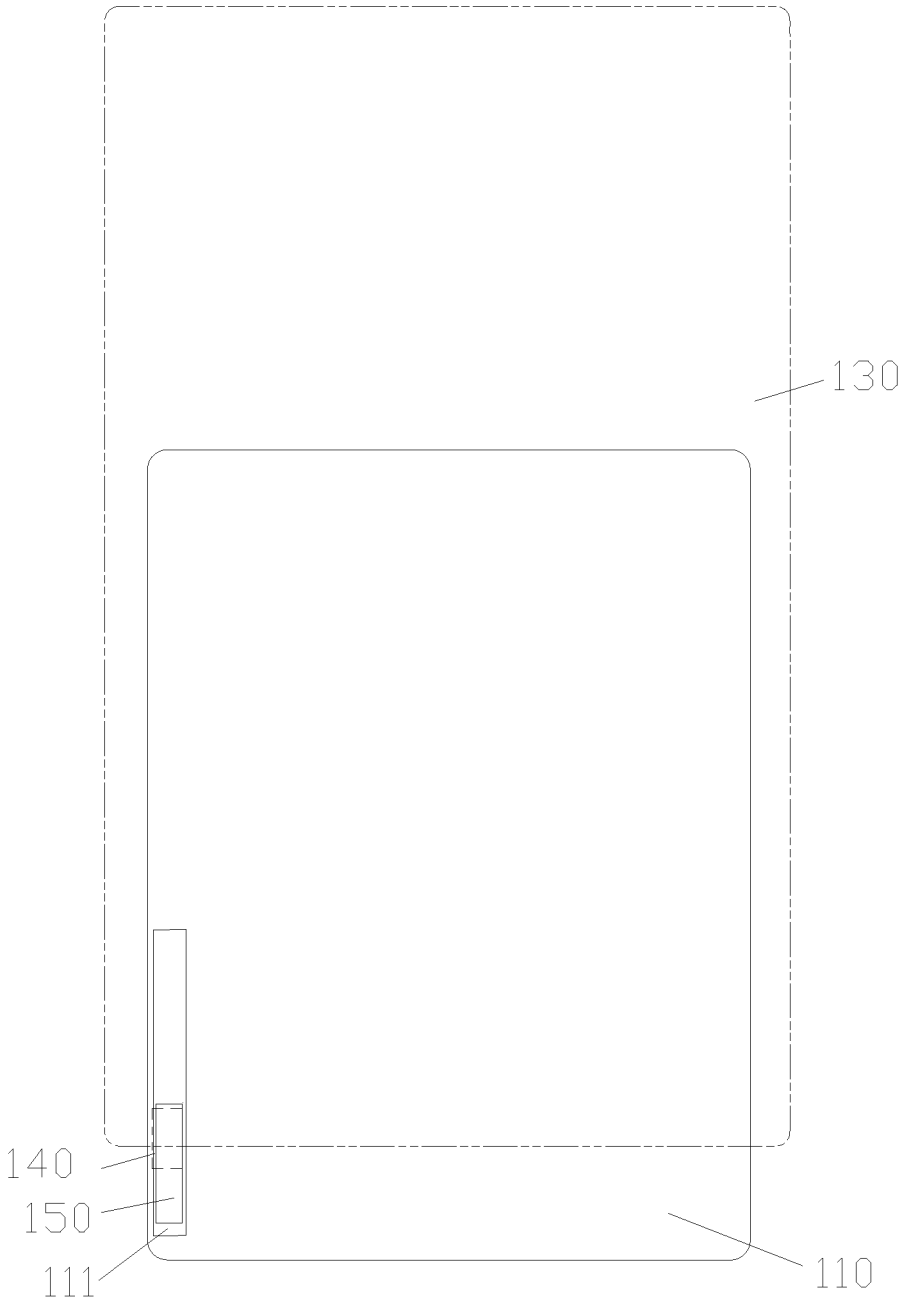
FIG. 2 illustrates a schematic structural diagram of an electronic device in a second operating state according to some embodiments of the present disclosure.

| | |
|---|---|
| 110 | Base; |
| 111 | First sliding track; |
| 112 | Second sliding track; |
| 113 | Third sliding track; |
| 114 | Fourth sliding track; |
| 121 | First connection member; |
| 122 | Second connection member; |
| 123 | Third connection member; |
| 130 | Body; |
| 140 | Antenna assembly; |
| 150 | Shield member; |
| 160 | Linkage; |
| 170 | Elastic member. |

DETAILED DESCRIPTION OF THE EMBODIMENTS

The present disclosure is further described in detail below in connection with the accompanying drawings and embodiments of the present disclosure. Embodiments of the present disclosure described here are only used to explain the present disclosure and are not used to limit the present disclosure.

In the description of embodiments of the present disclosure, unless otherwise specified and limited, the term "connection" should be understood in a broad sense. For example, it can be an electrical connection, a connection between two elements, a direct connection, or an indirect connection through an intermediary. For those of ordinary skill in the art, the specific meanings of the above terms may be understood according to specific situations.

The terms "first\second\third" in embodiments of the present disclosure are merely used to distinguish similar objects, and do not represent a specific order for the objects. "first\second\third" may be interchanged in specific order or sequence when permitted. The objects distinguished by "first\second\third" may be interchangeable under appropriate situations. Thus, embodiments of the present disclosure described her may be implemented in a sequence other than those illustrated or described here.

When there is no conflict, embodiments of the present disclosure and features of embodiments may be combined with each other. An electronic device of embodiments of the present disclosure is described in detail below in connection with FIGS. 1 to 6.

The electronic device includes a base 110, a connection device, a body 130, an antenna assembly 140, and a shield member 150. The connection device is connected to the base 110. The body 130 is connected to the connection device. The body 130 may be rotated to a first operating state and a second operating state relative to the base 110 through the connection device. The antenna assembly 140 is arranged in the base 110. The shield member 150 is arranged in the base 110. The shield member 150 may move to a shielding state and a non-overlapping state in the base 110. When the body 130 is in the first operating state, the body 130 may be not overlapping with the antenna assembly 140 in a first direction, the shield member 150 may be in the non-overlapping state, and the shield member 150 may be not overlapping with the antenna assembly 140 in the first direction. When the body 130 is in the second operating state, the body 130 may overlap at least a part of the antenna assembly 140 in the first direction, the shield member 150 may be in the shielding state, and the shield member 150 may shield between the antenna assembly 140 and the body 130 in the first direction. Thus, body 130 and the antenna assembly 140 are separated by the shield member 150 to prevent the body 130 from affecting the performance of the antenna assembly 140. The electronic device may only need to include one set of antenna assembly 140, and the structure may be simple.

In embodiments of the present disclosure, the base 110 may be configured to support the electronic device. The structure of the base 110 is not limited, as long as the base 110 can support the electronic device.

In embodiments of the present disclosure, the structure of the connection device may not be limited. For example, the connection device may include a rotation shaft structure.

A connection method of the connection device and the base 110 may not be limited. For example, when the connection device is the rotation shaft structure, the connection device may be fixedly connected or rotatably connected to the base 110.

In embodiments of the present disclosure, the structure of the body 130 may not be limited. For example, the body 130 may include a display screen.

The implementation of the connection of the body 130 and the connection device may not be limited. For example, when the connection device is the rotation shaft structure, the connection device may be fixedly connected to the base 110. Correspondingly, the connection device may be rotatably connected to the body 130, or the connection device may be rotatably connected to the base 110. Correspondingly, the connection device may be fixedly connected to the body 130.

The first operating state and the second operating state may not be limited. In some embodiments, the body 130 may include the display screen. The first operating state may include a landscape state, and the second operating state may include a vertical state.

In embodiments of the present disclosure, the structure of the shield member 150 may not be limited. For example, the shield member 150 may include a plate structure or a sheet structure.

Embodiments of the shield member 150 moving in the base 110 to the shielding state and the non-overlapping state may not be limited by the embodiments in the present disclosure. For example, the shield member 150 may be movably arranged at the base 110. The shield member 150 may move to the shielding state and the non-overlapping state. In some embodiments, the base 110 may include a slide rod. The shield member 150 may be sleeved at the slide rod. The shield member 150 may move in the base 110 to the shielding state and the non-overlapping state by sliding at the slide rod. In some other embodiments, the shield member 150 may be rotatably arranged at the base 110. The shield member 150 may rotate to the shielding state and the non-overlapping state.

In embodiments of the present disclosure, when the body 130 may be in the first operating state, the body 130 may be not overlapping with the antenna assembly 140 in the first direction. The shield member 150 may be in the non-overlapping state. The shield member 150 may be not overlapping with the antenna assembly 140 in the first direction. That is, the body 130 may not affect the performance of the antenna assembly 140 in the first direction. When the body 130 is in the second operating state, the body 130 may overlap at least a portion of the antenna assembly 140 in the first direction. The shield member 150 may be in the shielding state. The shield member 150 may shield between the antenna assembly 140 and the body 130 in the first direction. That is, the body 130 and the antenna assembly 140 may be separated by the shield member 150 to prevent the body 130 from affecting the performance of the antenna assembly 140. The electronic device may only include one set of the antenna assembly 140, and the structure may be simple.

The material of the shield member 150 should not be limited. As long as the shield member 150 can prevent the body 130 from affecting the performance of the antenna assembly 140. For example, the material of the shield member 150 may include plastic. In some embodiments, the material of the shield member 150 may include Polyvinyl chloride (PVC), Acrylonitrile Butadiene Styrene plastic (ABS), and Polycarbonate (PC).

A dielectric constant of the shield member 150 may range from 2 to 9.

The first direction may no be limited by specific embodiments. For example, the first direction may include a thickness direction of the base 110.

When the body 130 changes from the first operating state to the second operating state, since the body 130 overlaps the at least a portion of the antenna assembly 140 in the first direction, a center frequency of the antenna assembly 140 may change. The center frequency of the antenna assembly 140 may move to high-frequency. The shield member 150 may be configured to prevent the body 130 from shielding the antenna assembly 140 to cause the center frequency of the antenna assembly 140 to change. Thus, the performance of the antenna assembly may be ensured to remain stable.

In some embodiments, the base 110 may include a first sliding track 111. The shield member 150 may be snapped in the first sliding track 111. The shield member 150 may slide in the first sliding track 111 to a position of the shield state and a position of the non-overlapping state. Thus, when the body 130 is in the first operating state, the shield member 150 may slide to a position of the non-overlapping state through the first sliding track 111. When the body 130 is in the second operating state, the shield member 150 may slide to a position of the shielding state through the first sliding track 111.

In some embodiments, the implementation of driving the shield member 150 to slide in the first sliding track 111 is not limited by the specific embodiments in the present disclosure.

In some embodiments, the electronic device further includes a linkage 160. The linkage 160 may be movably connected to the base 110. The linkage 160 may be rotatably connected to the shield member 150. The linkage 160 may be configured to drive the shield member 150 to slide in the first sliding track 111.

In some embodiments, the implementation of driving the linkage 160 to move is not limited by the specific embodiments in the present disclosure.

For example, the based includes a second sliding track 112. The connection device includes a first connection member 121. A first end of the first connection member 121 may be inserted into the second sliding track 112. The first end of the first connection member 121 may be rotatably connected to the body 130. A second end of the first connection member 121 may be rotatably connected to the base 110. The first connection member 121 and the linkage 160 may be linked for movement. The first connection member 121 may be configured to drive the linkage 160 to move. When the body 130 changes from the first operating state to the second operating state through the first connection member 121, the first end of the first connection member 121 may slide from the first end of the second sliding track 112 to the second end of the second sliding track 112. The linkage 160 may move as the first end of the first connection member 121 slides and push the shield member 150 to slide in the first sliding track 111 from a position of the non-overlapping state to a position of the shielding state.

In some embodiments, the structure of the first connection member 121 is not limited by the specific embodiments in the present disclosure. For example, the first connection member 121 may include a rod structure.

In some embodiments, the second sliding track 112 may include an arch sliding track.

In some embodiments, the implementation of the linked movement of the first connection member 121 and the linkage 160 are not limited by the specific embodiments in the present disclosure. As long as the first connection member 121 may drive the linkage 160 to move. The linkage 160 may move as the first end of the first connection member 121 slides and push the shield member 150 to slide in the first sliding track 111 from a position of the non-overlapping state to a position of the shielding state.

Figure 3:
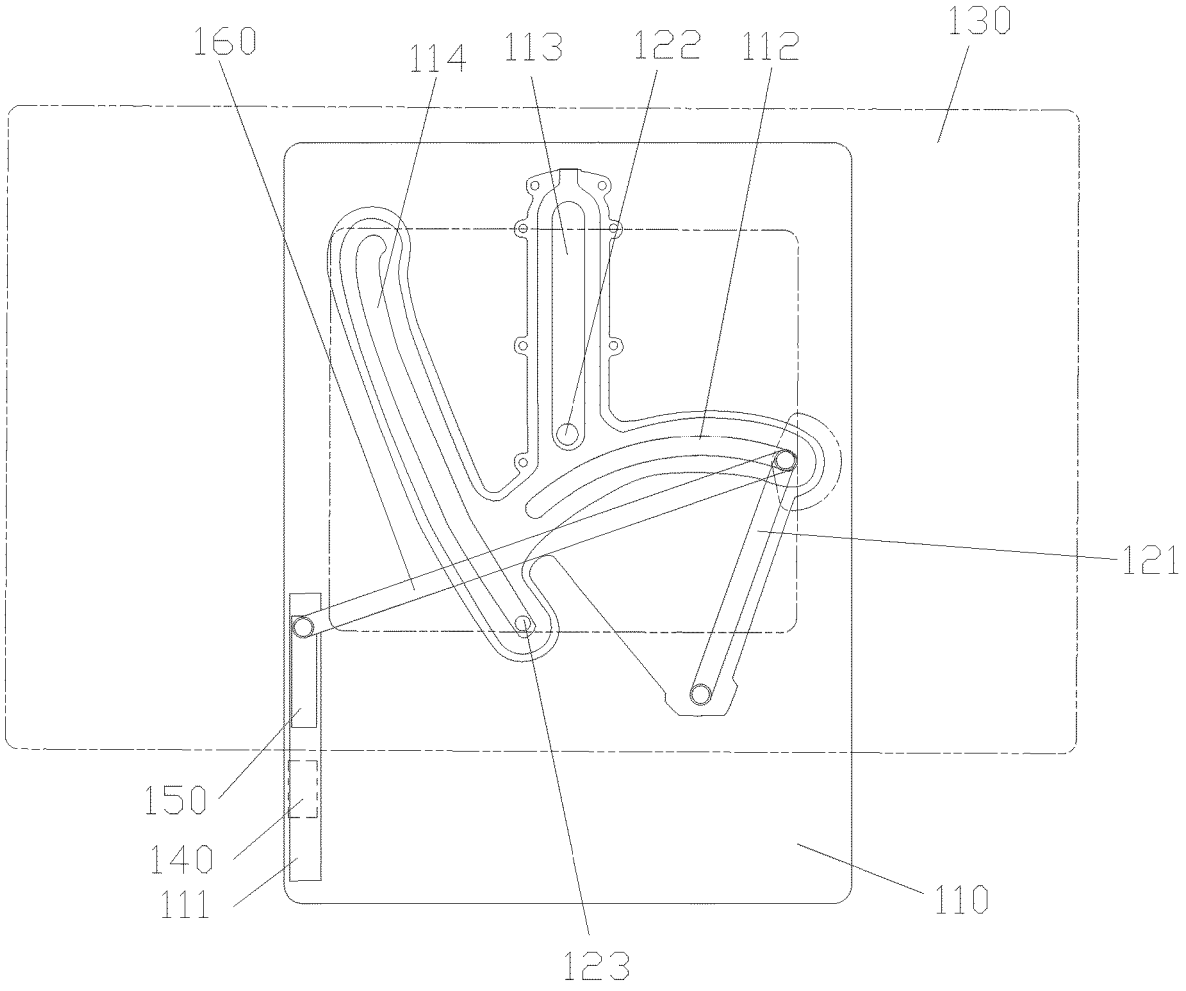
FIG. 3 illustrates a schematic structural diagram of an electronic device in a first operating state according to some embodiments of the present disclosure.
Figure 4:
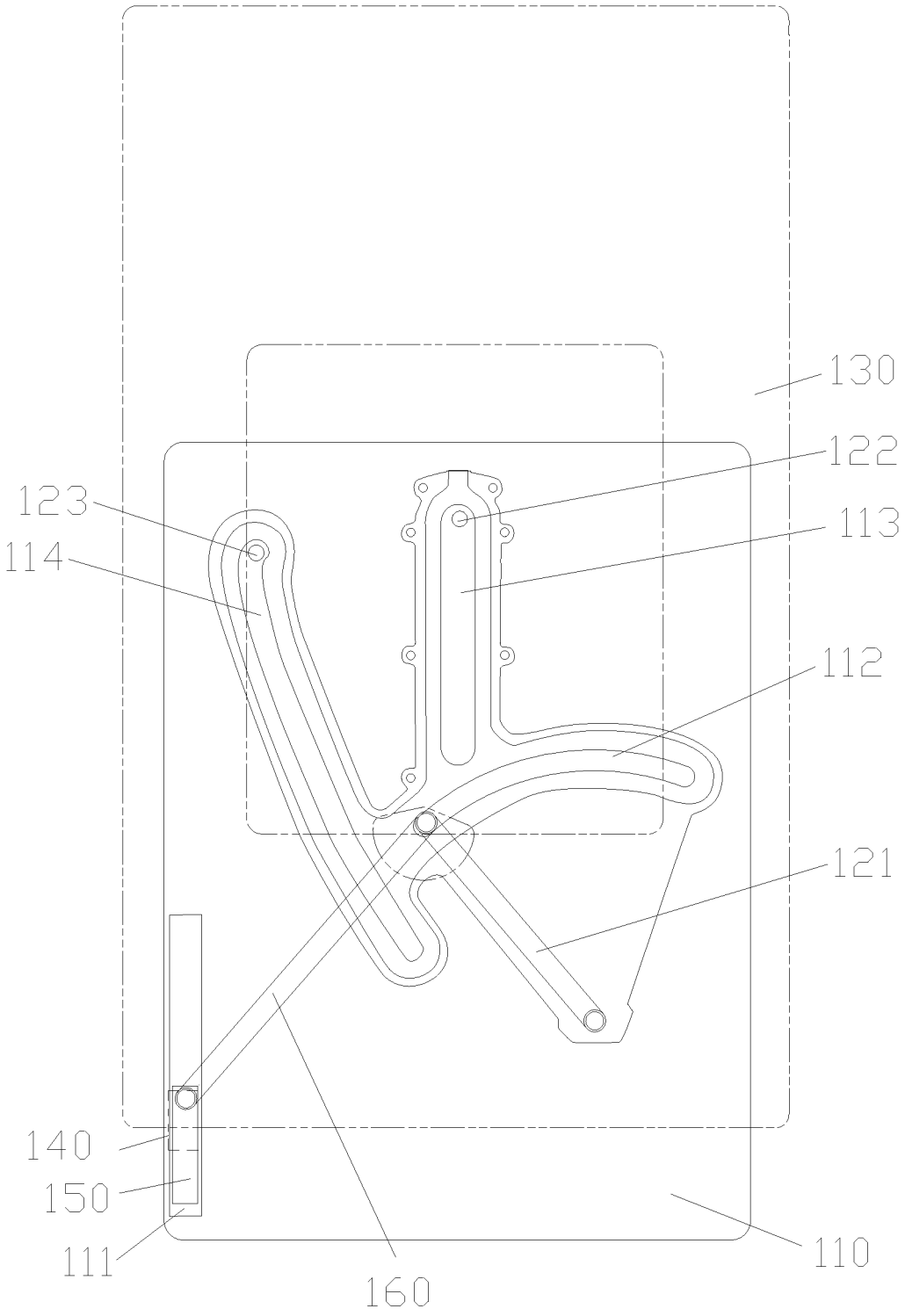
FIG. 4 illustrates a schematic structural diagram of an electronic device in a second operating state according to some embodiments of the present disclosure.

In some embodiments, as shown in FIG. 3 and FIG. 4, the first end of the first connection member 121 and the first end of the linkage 160 may be rotatably connected in the second sliding track 112. When the body 130 changes from the first operating state to the second operating state through the first connection member 121, the first end of the linkage 160 may slide with the first connection member 121 from the first end of the second sliding track 112 to the second end of the second sliding track 112. The second end of the linkage 160 may rotate and push the shield member 150 to slide in the first sliding track 111 from a position of the non-overlapping state to a position of the shielding state. When the body 130 changes from the second operating state to the first operating state through the first connection member 121, the first end of the linkage 160 may slide with the first connection member 121 from the second end of the second sliding track 112 to the first end of the second sliding track 112. The second end of the linkage 160 may rotate and pull the shield member 150 to slide in the first sliding track 111 from a position of the shielding state to a position of the non-overlapping state.

In some other embodiments, the first end of the linkage 160 may be rotatably connected to the middle of the first connection member 121.

Figure 5:
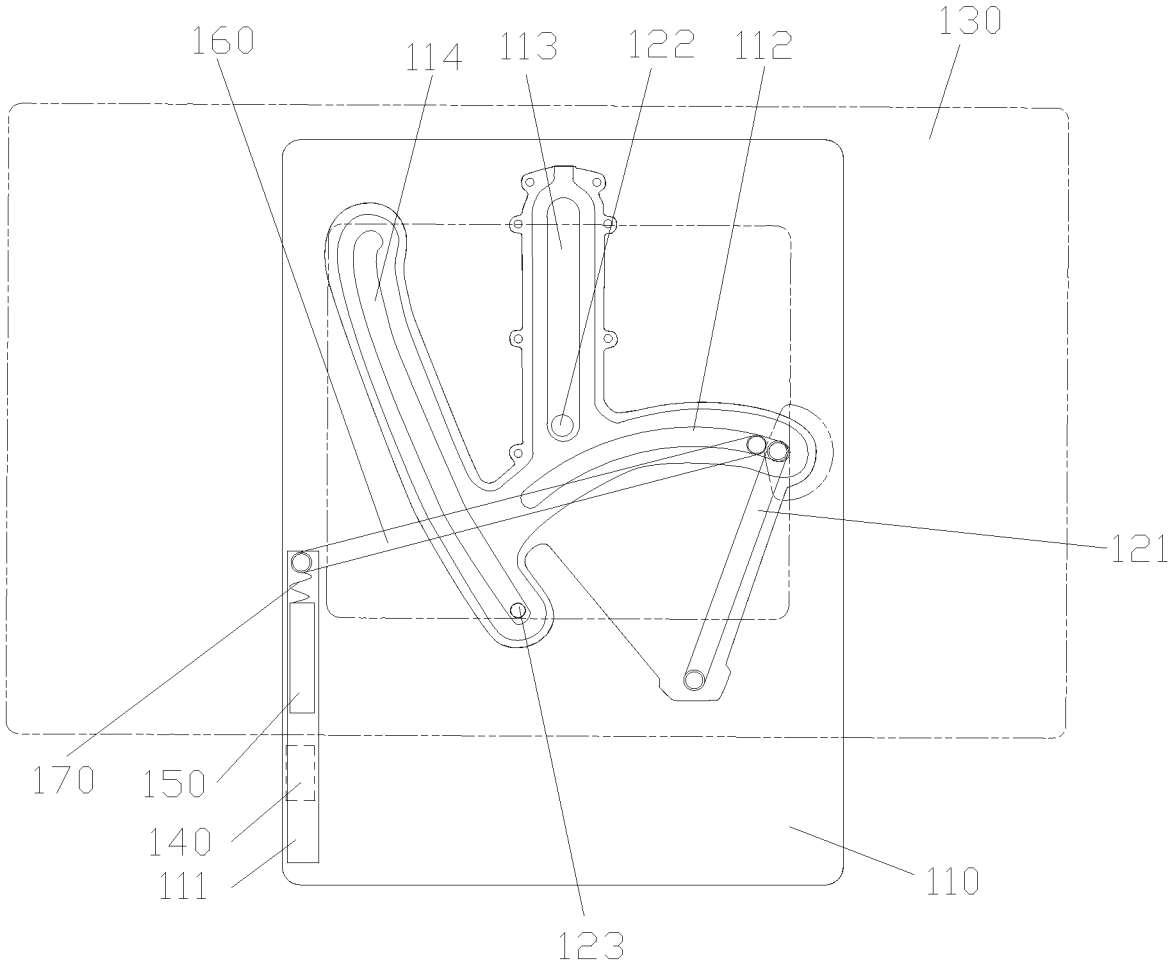
FIG. 5 illustrates a schematic structural diagram of an electronic device in a first operating state according to some embodiments of the present disclosure.
Figure 6:
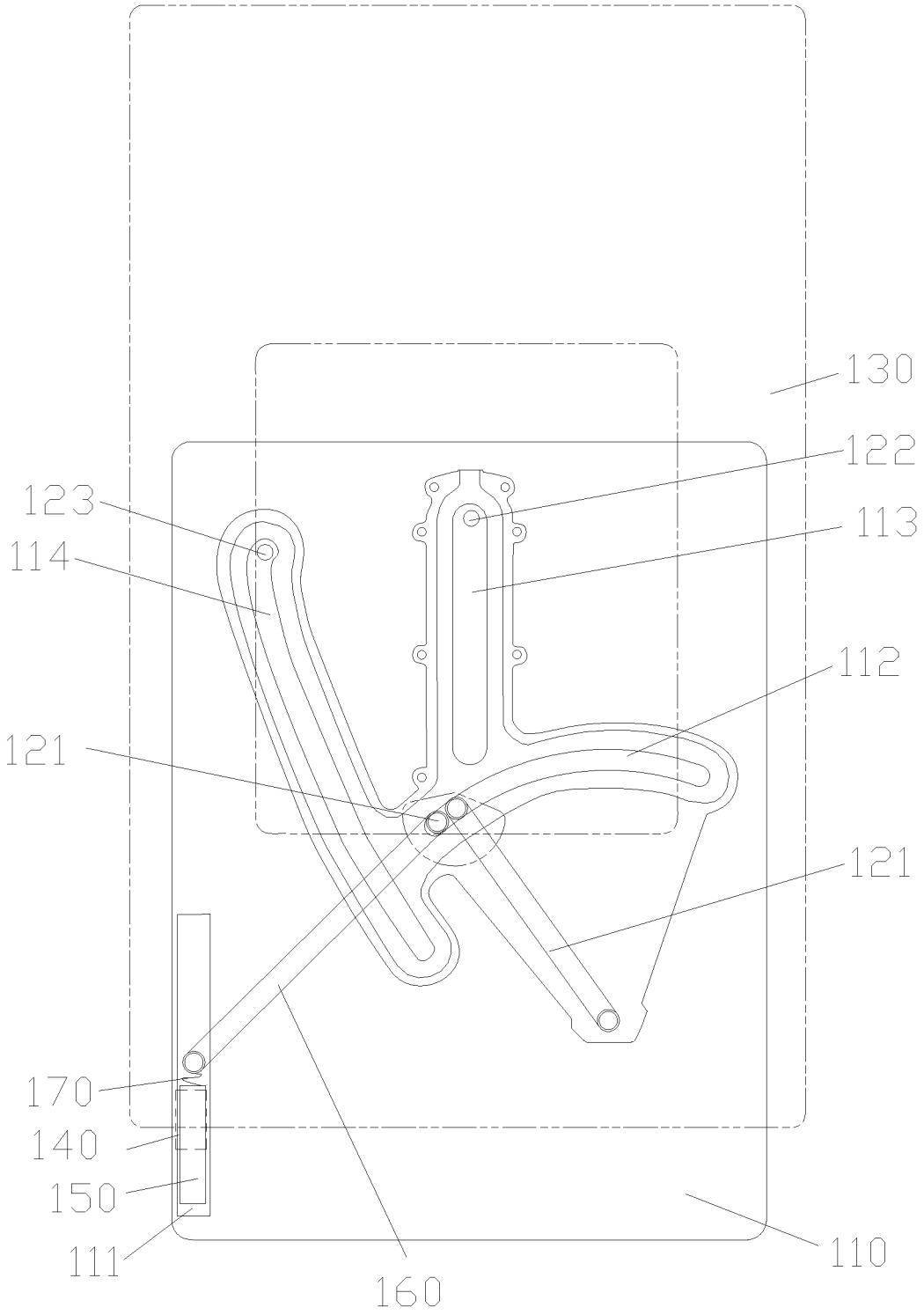
FIG. 6 illustrates a schematic structural diagram of an electronic device in a second operating state according to some embodiments of the present disclosure.

In some other embodiments, as shown in FIG. 5 and FIG. 6, the electronic device further includes an elastic member 170. The elastic member 170 is arranged in the first sliding track 111. The elastic member 170 is connected to the linkage 160 and the shield member 150. The first end of the first connection member 121 and the first end of the linkage 160 may be arranged in the second sliding track 112. When the body 130 changes from the first operating state to the second operating state through the first connection member 121, the first end of the first connection member 121 may push the first end of the linkage 160 to slide from the first end of the second sliding track 112 to the second end of the second sliding track 112. The second end of the linkage 160 may rotate to push the shield member 150 to slide in the first sliding track 111 from a position of the non-overlapping state to a position of the shielding state through the elastic member 170. The elastic member 170 may deform. When the body 130 changes from the second operating state to the first operating state through the first connection member 121, the first end of the first connection member 121 may slide from the second end of the second sliding track 112 to the first end of the second sliding track 112. The first end of the linkage 160 may slide from the second end of the second sliding track 112 to the first end of the second sliding track 112 under the action of the restoring force of the elastic member 170. The elastic member 170 may pull the shield member 150 to slide in the first sliding track 111 from a position of the shielding state to a position of the non-overlapping state.

The structure of the elastic member 170 is not limited by the specific embodiments in the present disclosure. For example, the elastic member 170 may include a spring.

As shown in FIG. 3 to FIG. 5, the connection device further includes a second connection member 122 and a third connection member 123. The base 110 further includes a third sliding track 113 and a fourth sliding track 114. The second connection member 122 may be inserted in the third sliding track 113. The second connection member 122 may slide in the third sliding track 113. The second connection member 122 may be rotatably connected to the body 130. The third connection member 123 may be inserted in the fourth sliding track 114. The third connection member 123 may be rotatably connected to the base 130. The body 130 may change between the first operating state and the second operating state through the first connection member 122, the second connection member 122, and the third connection member 123.

In some embodiments, the electronic device may further include a motor and a gear fixed at a rotation shaft of the motor. A first gear portion may be arranged on a side of the shield member 150. The first gear portion may mesh with a second gear portion. The motor may be configured to drive the shield member 150 to slide in the first sliding track 111 to a position of the shielding state and a position of the non-overlapping state through the gear.

In some embodiments, the electronic device may further include a driver, a detector, and a controller. The driver may be connected to the shield member 150. The driver may be configured to drive the shield member 150 to move. The detector may be configured to detect the state of the body 130. The controller may be electrically connected to the driver. The controller may be electrically connected to the detector. The controller may be configured to, when the detector detects that the body 130 changes from the first operating state to the second operating state, control the driver to drive the shield member 150 to move from the non-overlapping state to the shielding state. The controller may be further configured to, when the detector detects that the body 130 changes from the second operating state to the first operating state, control the driver to drive the shield member 150 to move from the shielding state to the non-overlapping state.

In some embodiments, the structure of the driver is not limited by the specific embodiments in the present disclosure. For example, the driver may include a motor. The motor may drive the shield member 150 to move, which is similar to the above description and is not repeated here. For another example, the driver may include a motor, the shield member 150 may be fixed at the rotation shaft of the motor. The motor may drive the shield member 150 to switch between the shielding state and the non-overlapping state.

In some embodiments, the structure of the detector is not limited by the specific embodiments in the present disclosure.

For example, the detector may include a position sensor. The detector may detect that the body 130 changes from the second operating state to the first operating state or from the first operating state to the second operating state through the position sensor.

For another example, the detector may include an angle sensor. The angle sensor may be arranged at the connection device. The angle sensor may be configured to detect an angle that the body 130 rotates relative to the base 110. By detecting the angle of the body 130 rotating relative to the base 110, the detector may detect that the body 130 changes from the second operating state to the first operating state or from the first operating state to the second operating state.

In the electronic device of embodiments of the present disclosure, when the body 130 is in the first operating state, the body 130 may be not overlapping with the antenna assembly 140 in the first direction. The shield member 150 may be in the non-overlapping state. The shield member 150 may be not overlapping with the antenna assembly 140 in the first direction. Thus, the body 130 may not affect the performance of the antenna assembly 140. When the body 130 is in the second operating state, the body 130 may overlap the at least a portion of the antenna assembly 140 in the first direction. The shield member 150 may be in the shielding state. The shield member 150 may shield between the antenna assembly 140 and the body 130 to separate the body 130 and the antenna assembly 140 through the shield member 150 and prevent the body 130 from affecting the performance of the antenna assembly 140. Thus, the electronic device may only need one set of the antenna assembly 140, and the structure may be simple.

The above are only specific embodiments of the present disclosure. The scope of the present disclosure is not limited to these. Those skilled in the art may easily think of changes or substitutions within the technical scope of the present disclosure. These changes and substitutions should be within the scope of the present disclosure. Therefore, the scope of the present invention should be subject to the scope of the claims.

What is claimed is:

1. An electronic device, comprising:

a base;

a connection device connected to the base;

a body connected to the connection device, the body rotating to a first operating state and a second operating state relative to the base through the connection device;

an antenna assembly arranged in the base; and a shield member arranged in the base, the shield member moving in the base to a shielding state and a non-overlapping state;

wherein:

in response to the body being in the first operating state, the body is not overlapping with the antenna assembly in a first direction, the shield member is in the non-overlapping state, and the shield member is not overlapping with the antenna assembly in the first direction; and in response to the body being in the second operating state, the body overlaps at least a portion of the antenna assembly in the first direction, the shield member is in the shielding state, and the shield member shields between the antenna assembly and the body.

2. The device of claim 1, wherein:

in response to the body changing from the first operating state to the second operating state, the shield member is configured to prevent the body from shielding the antenna assembly to cause a center frequency of the antenna assembly to change.

3. The device of claim 1, wherein:

the base includes a first sliding track;

the shield member is snapped in the first sliding track; and the shield member slides in the first sliding track to a position of the shielding state and a position of the non-overlapping state.

4. The device of claim 3, further comprising:

a linkage movably connected to the base and rotatably connected to the shield member, the linkage being configured to drive the shield member to slide in the first sliding track.

5. The device of claim 4, wherein:

the base includes a second sliding track;

the connection device includes:

a first connection member, a first end of the first connection member being inserted and sliding in the second sliding track, the first end of the first connection member being rotatably connected to the body, a second end of the first connection member being rotatably connected to the base, the first connection member being linked to the linkage for movement, and the first connection member being configured to drive the linkage to move;

in response to the body changing from the first operating state to the second operating state through the first connection member, the first end of the first connection member slides from a first end of the second sliding track to a second end of the second sliding track, the linkage moves as the first end of the first connection member slides and pushes the shield member to slide in the first sliding track from a position of the non-overlapping state to a position of the shielding state.

6. The device of claim 4, further comprising:

an elastic member arranged in the first sliding track and connected to the linkage and the shield member;

wherein:

a first end of a first connection member and a first end of the linkage are arranged in a second sliding track;

in response to the body changing from the first operating state to the second operating state through the first connection member, the first end of the first connection member pushes the first end of the linkage to slide from the first end of the second sliding track to a second end of the second sliding track, a second end of the linkage rotates and pushed the shield member to slide in the first sliding track from a position of the non-overlapping state to a position of the shielding state through the elastic member, and the elastic member deforms; and in response to the body changing from the second operating state to the first operating state through the first connection member, the first end of the first connection member slides from the second end of the second sliding track to the first end of the second sliding track, the first end of the linkage slides from the second end of the second sliding track to the first end of the second sliding track under an action of a restoration force of the elastic member, and the elastic member pulls the shield member to slide in the first sliding track from a position of the shielding state to a position of the non-overlapping state.

7. The device of claim 4, wherein:

a first end of a first connection member and a first end of the linkage are rotatably connected in a second sliding track;

in response to the body changing from the first operating state to the second operating state through the first connection member, the first end of the linkage slides with the first connection member from the first end of the second sliding track to a second end of the second sliding track, a second end of the linkage rotates and pushes the shield member to slide in the first sliding track from a position of the non-overlapping state to a position of the shielding state; and in response to the body changing from the second operating state to the first operating state through the first connection member, the first end of the linkage slides with the first connection member from the second end of the second sliding track to the first end of the second sliding track, and the second end of the linkage rotates to pull the shield member to slide in the first sliding track from a position of the shielding state to a position of the non-overlapping state.

8. The device of claim 1, further comprising:

a driver connected to the shield member and configured to drive the shield member to move;

a detector configured to detect a state of the body; and a controller electrically connected to the driver and the detector, the controller being configured to:

in response to the detector detecting that the body changing from the first operating state to the second operating state, control the driver to drive the shield member to move from a position of the non-overlapping state to a position of the shielding state; and in response to the detector detecting that the body changing from the second operating state to the first operating state, control the driver to drive the shield member to move from a position of the shielding state to a position of the non-overlapping state.

9. The device of claim 1, wherein:

the body includes a display screen;

the first operating state includes a landscape state; and the second operating state includes a vertical state.

10. The device of claim 1, wherein:

a dielectric constant of the shield member ranges from 2 to 9;

a material of the shield member includes plastic; and the first direction is a thickness direction of the base.

* * * * *